United States Patent [19]

Kulesza et al.

[11] 4,282,848

[45] Aug. 11, 1981

[54] BATTING PRACTICE APPARATUS

[75] Inventors: Ralph J. Kulesza, Chicago; Burton C. Meyer, Downers Grove; Donald F. Nix, Hanover Park, all of Ill.

[73] Assignee: Marvin Glass & Associates, Chicago, Ill.

[21] Appl. No.: 106,283

[22] Filed: Dec. 21, 1979

[51] Int. Cl.[3] ..... F41B 7/00

[52] U.S. Cl. ..... 124/16; 124/50; 124/41 R; 124/36; 124/51 R

[58] Field of Search ..... 124/16, 17, 31, 34, 124/41 R, 49, 1, 50, 51 R

[56] References Cited

U.S. PATENT DOCUMENTS

| | | | |
|---|---|---|---|
| 3,777,733 | 12/1970 | Mitchell | 124/50 X |
| 3,804,071 | 4/1974 | Winrow | 124/16 |
| 3,977,386 | 8/1976 | Meyer | 124/41 R X |
| 4,209,003 | 6/1980 | Sainsbury | 124/41 R X |

*Primary Examiner*—Richard C. Pinkham
*Assistant Examiner*—William R. Browne
*Attorney, Agent, or Firm*—Mason, Kolehmainen, Rathburn & Wyss

[57] ABSTRACT

Batting practice apparatus for projecting balls upwardly into the air to be hit by a bat comprises trough for holding a plurality of balls to move in a sequence toward a feed position adjacent a stop at a lower end. A holding ring is mounted adjacent the stop for supporting a single ball in a ready position to be projected upwardly into the air. A feeder is provided for sequentially moving the balls from a feed position in the trough adjacent the stop into a ready position in the holding ring and a motor in the form of a foot operated lever and a time delay mechanism is operable for forcefully propelling the balls upwardly out of the holding ring so that a batter may step into position and swing at the balls as they pop-up into the air.

17 Claims, 4 Drawing Figures

BATTING PRACTICE APPARATUS

BACKGROUND OF THE INVENTION

1. Field of the Invention

The present invention relates generally to batting practice apparatus and more particularly to batting practice apparatus designed to project balls upwardly into the air in a controlled sequence with a time delay so that a person can get in proper position to hit the balls with a bat.

2. Description of the Prior Art

A variety of different types of apparatus have been developed for projecting a single ball up into the air to be hit by a batter, and U.S. Pat. No. DE. 249,287 along with U.S. Pat. Nos. 3,612,027; 3,627,319 and 3,368,541 disclose various types of batting practice aids for use in practicing the art of hitting a baseball.

OBJECTS OF THE PRESENT INVENTION

It is an object of the present invention to provide a new and improved batting practice apparatus and more particularly an apparatus wherein a plurality of balls are moved in controlled sequence into a ready position wherein the balls are then propelled upwardly into the air to be hit by a bat.

More particularly, another object is to provide a new and improved batting practice apparatus of the character described wherein an automatic time delay is provided between the time the apparatus is activated to propel or pop-up a ball and the actual time that the ball is tossed upwardly so that a batter may step back and ready his swing.

Yet another object of the present invention is to provide a new and improved batting practice apparatus of the character described which is low in cost, neat in appearance, simple and trouble-free in operation, and which lends itself readily to mass production techniques.

Yet another object of the present invention is to provide a new and improved batting practice apparatus which is capable of operation to provide a selectively controlled sequence for propelling or popping-up the balls into the air, ready to be hit by a swinging bat.

Yet another object of the present invention is to provide a new and improved batting apparatus of the character described wherein the upward propelling force on each ball is selectively controllable to achieve the desired height.

SUMMARY OF THE INVENTION

The foregoing and other objects and advantages of the present invention are accomplished in a new and improved batting practice apparatus adapted to handle a plurality of balls and project the balls upwardly into the air in a controlled sequence so that the balls can be hit by a swinging bat. The apparatus includes a trough for holding a plurality of balls to move in sequence towards a feed position adjacent a stop at a lower end of the trough. A holding ring is mounted adjacent the stop for supporting a single ball in a ready position for upward projecting or pop-up into the air when released. A feeder is utilized for sequentially moving a ball from the feed position at the stop, out of the trough into the ready position in the holding ring and a foot pedal controlled motor mechanism is provided for forcefully propelling or popping-up the ball from the holding ring with an automatic time delay occurring after the foot pedal is released so that a batter may step back into a good position, ready for a swing of the bat to hit the ball.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
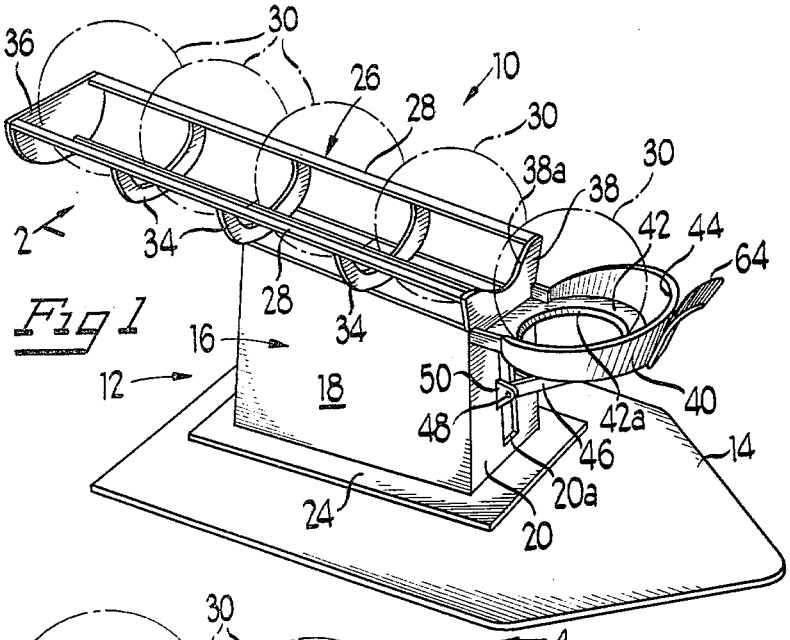
FIG. 1 is a perspective view of a new and improved batting practice apparatus constructed in accordance with the features of the present invention and illustrated in a position ready for operation.
Figure 4:
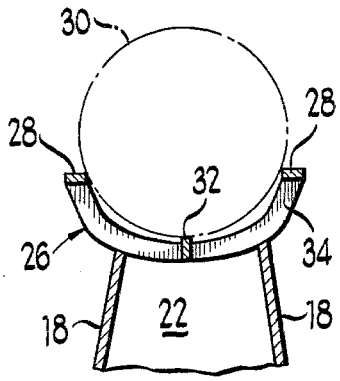
FIG. 4 is a transverse vertical cross-sectional view taken substantially along lines 4—4 of FIG. 2.

Referring now more particularly to the drawings, therein is illustrated a new and improved batting practice apparatus constructed in accordance with the features of the present invention and referred to generally by the reference numeral 10. The apparatus 10 includes a base structure 12 comprising a flat base plate 14 having a pointed end as illustrated in FIG. 1, which supports an upstanding, hollow pedestal structure 16 preferably formed of integrally molded plastic material.

The pedestal includes a pair of upwardly and inwardly sloping, opposite sidewalls 18, an inward sloping upstanding front end wall 20 and a similar upstanding rear wall 22 and these walls provide a large generally rectangular, horizontal, transverse cross-section. Around the lower edge of the side and end walls there is formed an integral peripheral flange 24 secured to the upper surface of the base plate 14.

At the upper end, the pedestal 16 supports an elongated trough structure 26 including a plurality of longitudinally extending guide ribs or side rails 28 adapted to hold and contain a plurality of spherical balls such as baseballs 30 aligned in a row in the trough to roll downwardly in sequence towards a lower-most "feed position" at the lower end of the trough adjacent the front wall 20 of the pedestal.

The trough structure 26 also includes an elongated, centrally disposed rib or rail 32 along the longitudinal center at the bottom of the trough structure and a plurality of intermediately spaced, laterally extending U-shaped ribs 34 are provided to interconnect and join the side rails 28 and the longitudinal center rail 32 into an integral, but light weight trough structure. At the rearward end, the trough is provided with a semicircular-shaped rear end wall 36 and at the forward end, a stop wall 38 is provided having a U-shaped upper stop surface 38*a* with a central portion thereof depressed so that the ball 30 in the lowermost "feed position" in the trough may be more easily lifted or elevated over the top edge of the stop wall onto a ring-like holding cup 40. The cup is adapted to hold a single ball in a "ready position" to be propelled upwardly in the course of operation of the apparatus.

Figure 2:
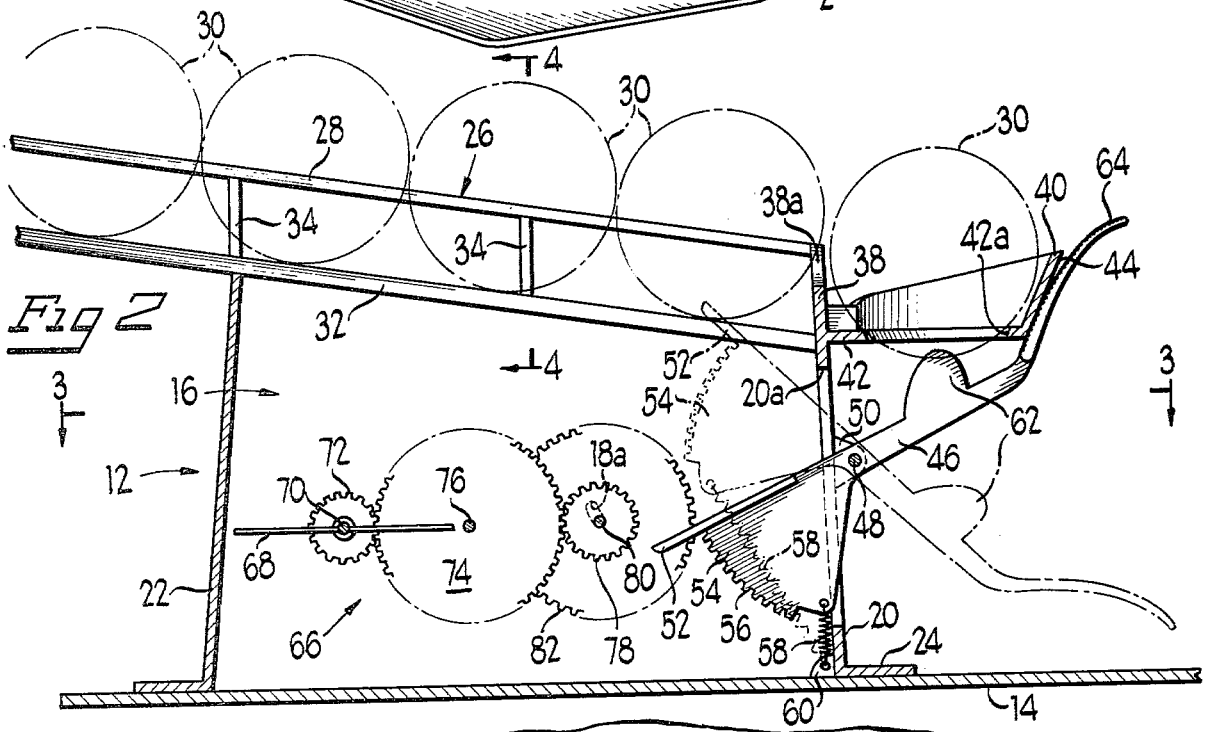
FIG. 2 is a vertical, longitudinally extending cross-sectional view of the apparatus of FIG. 1.
Figure 3:
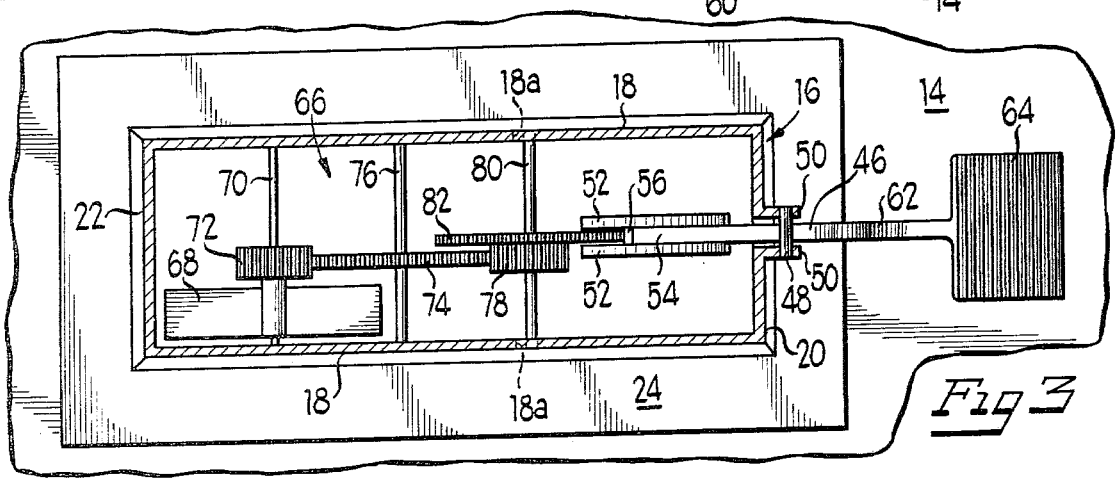
FIG. 3 is a horizontal cross-sectional view taken substantially along lines 3—3 of FIG. 2.

The cup-like ball holding structure 40 includes a flat bottom wall 42 having a centrally disposed, circular opening 42*a* defined therein for seating and centering a ball 30 in the "ready position" as shown in FIGS. 1 and 2. An upwardly and outwardly sloped, funnel-like sidewall 44 extends around the bottom wall with a front edge portion having a greater height than an inner edge portion adjacent the pedestal wall 20. The funnel-like wall helps to prevent a ball 30 from bouncing out of the cup structure 40 as the ball is elevated over the stop surface edge 38*a* and moved forwardly into the cup.

The trough structure 26 is constructed to hold a plurality of baseballs 30, for example, four or five balls, aligned in a row, and as each ball moves downwardly in the trough structure to reach the "feed position" adjacent the stop 38 it is finally lifted or elevated over the surface 38*a* and falls into the "ready position" centered in the holding cup 40.

In accordance with the present invention, the practice batting apparatus 10 includes a feed and motor mechanism for sequentially feeding a lowermost ball from the "feed position" adjacent the stop 38 in the trough 26 into the "ready position" centered in the cup structure 40 and thereafter propelling or tossing the ball upwardly from the cup so that a batter may practice swinging at the ball popped up in the air. The feed and motor mechanism comprises an operating lever 46 mounted for pivotal movement intermediate its ends on an axle pin 48 extending between a pair of spaced apart, outwardly extending brackets 50. The brackets ae integrally formed on the front wall 20 of the pedestal 16 on opposite sides of a centrally disposed, vertical slot 20*a*.

The lever 46 includes an inner end portion comprising a pair of ball lifting or feed fingers 52 adapted to engage the underside of a ball 30 in the "feed position" and lift the ball upwardly over the stop surface 38*a* to roll into the cup 40 as the lever is pivoted in a clockwise direction from a first position shown in solid lines in FIG. 2 toward a second position shown in dotted lines therein. The fingers 52 are spaced on opposite sides of the center trough rail 32 to elevate and propel the ball over the stop 38. As each ball is fed from the trough into the ready position in the cup as described, the remaining balls in the trough move downwardly toward the stop. As illustrated in FIG. 2, the outer ends of the feed fingers 52 are adapted to project upwardly above the upper edge of the center trough rail 32 to directly engage the underside of the ball 30. It should be noted that the angle of contact between the feed fingers and the ball is such to cause the ball to roll forwardly toward the ready position in the cup structure 40.

The portion of the lever 46 extending into the pedestal 16 through the slot 20*a* also includes an arcuate-shaped gear sector 54 downwardly below the feed fingers 52 and the gear sector includes a row of teeth 56 beginning at a level spaced a distance below the feed fingers and terminating at a level spaced above a lower corner. The gear sector is normally biased in a counterclockwise direction by a coil spring 58 having an upper end connected to a lower corner thereof and a lower end of the spring is connected to an internal, upstanding bracket 60 in the hollow interior of the pedestal structure 16.

An outer end portion of the lever 46 is formed with an integral, egg-shaped, upstanding striker element 62 having an upper edge surface adapted to engage the underside of the ball 30 in the ready position in the cup structure 40 when the lever is released to pivot in a counterclockwise direction. The striker is dimensioned so that an upper surface thereof moves generally along a vertical path centered in the aperture 42*a* of the cup structure 40 so that a ball 30 hit by the striker will be forcefully propelled or tossed upwardly in a generally vertical direction. Angular variations in the flight of the balls tossed up will sometimes occur and the batters will have to adjust accordingly.

At the outer end, the lever 46 is formed with a foot pedal 64 having friction increasing ridges and grooves thereon so that a batter's foot or shoe surface will not readily slip off and release the lever when in a depressed condition. The foot pedal is first pressed downwardly from the upper position of FIG. 2 toward the downward position and as this occurs, the coil spring 58 is stretched out or elongated as shown. Subsequently, when the pedal is released, the spring tends to pivot the lever in a counterclockwise direction and the striker 62 moves upwardly to contact and pop-up the ball awaiting in the ready position in the cup structure 40.

Each time the foot pedal is depressed, a new ball 30 is transferred from the "feed position " in the trough structure 26 to the "ready position" in the cup structure 40. When the foot pedal is subsequently released, the ball is tossed upwardly so that a batter may take a swing.

In accordance with the present invention, the batting practice apparatus 10 includes a time delay mechanism 66 mounted in the hollow interior of the pedestal structure 16 and operatively engageable with the gear teeth 56 on the gear sector 54 of the lever 46. After release of the depressing force on the foot pedal 64, an automatic time delay will occur before the ball 30 in the ready position of the cup structure 40 is engaged by the striker to be popped-up for batting practice. This time delay gives a batter time to step away after release of the depressed pedal to get into a good position ready to swing the bat.

The time delay mechanism 66 includes a rotating air paddle wheel 68 carried on a shaft 70 extending between the opposite sidewalls 18 of the pedestal structure and the paddle wheel is driven to totate by an integral concentric pinion 72 which is meshingly engaged by a larger diameter drive gear 74. The gear is mounted on a shaft 76 parallel of the shaft 70 and rotatable at a reduced speed because of the differences in diameter between the large drive gear and smaller pinion. The gear 74 is drivingly engaged by a smaller diameter gear 78 mounted on a third shaft 80 which is supported at opposite ends for movement up and down in a pair of arcuate slots 18*a* formed on the inside surface of the pedestal sidewalls 18. The ends of the shaft 80 ae guided by the surfaces of the slots so that the shaft is generally maintained in parallel with the shafts 70 and 76 as it moves up and down. The arcuate slots 18*a* are concentrically disposed around the axis of the shaft 76 so that the gear 78 remains in meshing engagement with the gear 74 during the movements of the shaft.

The gear 78 is attached to a larger diameter gear 82 and when the shaft 80 is positioned in a lower position as shown in FIG. 2, the teeth of the large gear 82 are mounted in a position to be engaged by the teeth 56 on the gear sector 54 as the lever 46 pivots in a counterclockwise direction when the pedal is released. After release of the foot pedal 64, the spring 58 pivots the gear sector rapidly until a lower tooth of the string of teeth 56 first engages the teeth on the gear 82 and begins to drive the gear train to rotate the air paddle wheel 68. The force of driving the gear train retards the counterclockwise pivotal movement of the lever 46 resulting in a slow down or time delay until the uppermost tooth 56 on the gear sector 54 moves out of engagement with the teeth on the gear 82. When this occurs, the spring 58 is then effective to pivot the lever 46 more rapidly in a counterclockwise direction so that the striker 62 moves upwardly to forcefully contact and pop the ball 30 upwardly. The gear train and air paddle wheel of the time delay mechanism 66 permits a batter to release the depressed foot pedal 64 and then take time to step away into a good position ready to swing at the ball that will be propelled upwardly after a short delay time. After a ball is popped-up, a batter may then depress the foot pedal 64 downwardly to pivot the lever in a clockwise direction and as this occurs, the teeth 56 of the gear section 54 briefly engage the teeth on the gear wheel 82 causing the shaft 80 to be elevated in the slots 18*a*. When this happens, the teeth 56 no longer engage the teeth of the gear 82 so that no time delay is encountered as the pedal is depressed. The shaft 80 of the time delay gear train mechanism 66 is thus movable toward and away from the gear sector 54 in the slots 18*a* so that no time delay is encountered as the pedal is depressed and an automatic time delay occurs after the pedal is released before the ball is popped-up to be hit.

Although the present invention has been described with reference to a single illustrated embodiment thereof, it should be noted that numerous other modifications and embodiments can be devised by those skilled in the art that will fall within the spirit and scope of the principles of this invention.

What is claimed as new and desired to be secured by Letters Patent of the United States is:

1. Batting practice apparatus for projecting a ball upwardly into the air to be hit by a bat, comprising:

trough means for holding a plurality of balls to move in sequence toward a feed position against a stop at a lower end;

holding means adjacent said stop for supporting a single ball in a ready position to be projected upwardly into the air;

feed means for sequentially moving a ball in said feed position adjacent said stop from said trough means into said ready position in said holding means, motor means for forcefully propelling said ball in said ready position upwardly of said holding means into the air; and an arm pivotal upwardly from a first position spaced below said ball in said ready position toward a second position for striking said ball in said ready position to propel the same upwardly, said arm pivotal about an axis and including a feed portion to one side of said axis moveable from said second position spaced below the ball in said feed position towards said first position engaging said ball in said feed position to lift the same over said stop into said ready position, said arm also including a striker portion on the other side of said axis for striking said ball in said ready position to propel the same upwardly.

2. The apparatus of claim 1 wherein said arm is mounted for pivotal movement about an axis spaced between said feed position and said ready position.

3. The apparatus of claim 1 wherein said motor means includes time delay means for providing a time delay interval between the time said arm is released and the time said ball is engaged thereby after release.

4. The apparatus of claim 3 wherein said arm is mounted for pivotal movement when released between the first position spaced below said ball in said ready position and a second position for striking said ball to propel the same upwardly, and said arm includes means for biasing said arm toward said second position.

5. The apparatus of claim 3 wherein said time delay means is operative for a period starting after release of said arm and ending prior to striking said ball.

6. The apparatus of claim 5 wherein said time delay means includes a gear train having a drive gear and said arm includes an arcuate gear sector engaging said drive gear only during a range of angular movement of said arm less than the angular range between said first and second positions.

7. The apparatus of claim 6 wherein said drive gear is mounted for rotation about an axis movable toward and away from said gear sector in response to pivotal movement of said arm between said first and second positions.

8. The apparatus of claim 7 wherein said axis is movable away from said gear sector when said arm is pivotal from said second position toward said first position whereby said time delay means does not substantially delay the pivotal movement of said arm.

9. The apparatus of claim 8 wherein said axis returns toward said gear sector when said arm is moved from said first position toward said second position.

10. The apparatus of claim 1 including foot pedal means on said arm for moving said arm from said second position toward said first position to feed a ball from said trough means into said holding means and releasable to move in an opposite direction to propel said ball upwardly from said ready position in said holding means.

11. The apparatus of claim 10 including time delay means for providing a time delay interval between the time said foot pedal means is releasable and the time said ball is engaged by said arm and propelled upwardly.

12. The apparatus of claim 11 including means normally biasing said arm to pivot from said first position toward said second position.

13. The apparatus of claim 12 wherein said time delay means is operative to momentarily oppose said biasing means after said foot pedal means is released.

14. The apparatus of claim 13 wherein said time delay means is positioned to be engaged with said arm during only a portion of the travel of said arm from said first position toward said second position upon release of said foot pedal means.

15. The apparatus of claim 14 wherein said time delay means is movable out of engagement with said arm during movement of said arm from said second position toward said first position as said foot pedal means is depressed.

16. Batting practice apparatus for projecting a ball upwardly into the air to be hit by a bat, comprising:

trough means for holding a plurality of balls to move in sequence toward a feed position against a stop at a lower end;

holding means adjacent said stop for supporting a single ball in a ready position to be projected upwardly into the air;

feed means for sequentially moving the ball in said feed position adjacent said stop from said trough means into said ready position in said holding means;

motor means for forcibly propelling said ball in said ready position upwardly of said holding means into the air, said motor means including an arm moveable upwardly from a first position spaced below said ball in said ready position toward a second position for striking said ball in said ready position to propel the same upwardly;

foot pedal means on said arm for moving said arm from said second position toward said first position to feed a ball from said trough means into said holding means and releasable to move in an opposite direction to propel said ball upwardly from said ready position in said holding means;

time delay means for providing a time delay interval between the time said foot pedal means is releasable and the time said ball is engaged by said arm and propelled upwardly; and said time delay means being positioned to engage said arm during only a portion of travel of said arm from said first position towards the second position upon release of said foot pedal means.

17. Batting practice apparatus for projecting a ball upwardly into the air to be hit by a bat, comprising:

trough means for holding a plurality of balls to move in sequence toward a feed position against a stop at a lower end;

holding means adjacent said stop for supporting a single ball in a ready position to be projected upwardly into the air;

feed means for sequentially moving a ball in said feed position adjacent said stop from said trough means into said ready position in said holding means;

motor means for forcibly propelling said ball in said ready position upwardly of said holding means into the air, said motor means including an arm movable upwardly from a first position spaced below said ball in said ready position toward a second position for striking said ball in said ready position to propel the same upwardly;

foot pedal means on said arm for moving said arm from said second position toward said first position to feed a ball from said trough means into said holding means and releasable to move in an opposite direction to propel said ball upwardly from said ready position in said holding means;

time delay means for providing a time delay interval between the time said foot pedal means is releasable and the time said ball is engaged by said arm and propelled upwardly; and said time delay means being movable out of engagement with said arm during movement of said arm from said second position toward said first position as said foot pedal means is depressed.

* * * * *